US011522317B2

(12) United States Patent
Nava et al.

(10) Patent No.: US 11,522,317 B2
(45) Date of Patent: Dec. 6, 2022

(54) LINEAR LOCKING ELECTRICAL CONNECTORS

(71) Applicant: Hyundai Translead, San Diego, CA (US)

(72) Inventors: Sergio Villalobos Nava, Tijuana (MX); Jesus Rakob Melendez Vazquez, Tijuana (MX); Young Jae Park, Chula Vista, CA (US); Laura Homec, San Diego, CA (US)

(73) Assignee: Hyundai Translead, San Diego, CA (US)

( * ) Notice: Subject to any disclaimer, the term of this patent is extended or adjusted under 35 U.S.C. 154(b) by 43 days.

(21) Appl. No.: 17/222,386

(22) Filed: Apr. 5, 2021

(65) Prior Publication Data

US 2022/0320798 A1 Oct. 6, 2022

(51) Int. Cl.
*H01R 13/627* (2006.01)
*H01R 13/639* (2006.01)

(52) U.S. Cl.
CPC ..... *H01R 13/639* (2013.01); *H01R 2201/26* (2013.01)

(58) Field of Classification Search
CPC ..... H01R 13/639; H01R 13/6392; H01R 13/6271; H01R 13/6275
See application file for complete search history.

(56) References Cited

U.S. PATENT DOCUMENTS 2,753,536 A * 7/1956 Tjader ..... H01R 13/6392 439/369
3,475,716 A * 10/1969 Laig ..... H01R 13/6392 24/339
4,682,847 A * 7/1987 Moore ..... H01R 13/62933 439/372
4,917,627 A * 4/1990 Hendricks ..... H01R 13/6272 439/357
5,211,572 A * 5/1993 Comstock ..... H01R 13/6392 439/372
5,876,234 A * 3/1999 Hester ..... H01R 13/6392 439/369
6,135,803 A * 10/2000 Kovacik ..... H01R 13/6392 439/369
6,375,231 B1 * 4/2002 Picha ..... A61M 39/1011 604/905
6,957,977 B1 * 10/2005 Miller ..... H01R 13/6392 439/369

(Continued)

*Primary Examiner* — Thanh Tam T Le
(74) *Attorney, Agent, or Firm* — Procopio, Cory, Hargreaves & Savitch LLP

(57) ABSTRACT

An electrical connector apparatus, including: a first connector coupled to a first end of an electrical wire, the first connector including a locking hook; a second connector coupled to a second end of the electrical wire, the second connector including a first bumper; and a locking device configured to keep the first connector and the second connector coupled together and to keep the first end and the second end of the wire connected, the locking device including a ring and an arm, wherein the ring is configured to insert over the second connector until the ring is flush with the first bumper of the second connector, and the arm hooks onto the locking hook of the first connector when the ring is flush with the first bumper of the second connector.

15 Claims, 4 Drawing Sheets

(56) References Cited

U.S. PATENT DOCUMENTS

| | | | | |
|---|---|---|---|---|
| 7,186,130 | B1 * | 3/2007 | Miller | H01R 13/639 439/369 |
| 7,452,233 | B1 * | 11/2008 | Michelsen | H01R 13/6273 439/369 |
| 7,563,123 | B2 * | 7/2009 | Cave | H01R 13/6395 439/373 |
| 7,744,400 | B2 * | 6/2010 | Carmitchel | H01R 13/6275 439/369 |
| 8,506,319 | B2 * | 8/2013 | Ritter | H01R 13/6275 439/352 |
| 9,385,475 | B1 * | 7/2016 | Barna | H01R 13/6392 |
| 9,433,769 | B2 * | 9/2016 | Bayly | A61M 39/1011 |
| 10,135,190 | B2 * | 11/2018 | Bozikis | H01R 13/6392 |
| 10,320,122 | B2 * | 6/2019 | Bozikis | H01R 13/639 |
| 11,038,305 | B1 * | 6/2021 | Sampaio | H01R 13/6392 |

* cited by examiner

LINEAR LOCKING ELECTRICAL CONNECTORS

BACKGROUND

Field of the Invention

The present disclosure relates generally to electrical connectors, and more specifically, to electrical connectors including a linear locking mechanism.

Background

Electrical connectors used in vehicles or objects may be subjected to movements and vibrations, which may cause the electrical connections to break. Further, the movements and vibrations may cause damages to the electrical connectors beyond normal wear and tear.

SUMMARY

The present disclosure describes electrical connectors including a locking mechanism that holds the connectors together to prevent or at least lower the risk of a break in the electrical connection.

In one implementation, an electrical connector apparatus is disclosed. The apparatus includes: a first connector coupled to a first end of an electrical wire, the first connector including a locking hook; a second connector coupled to a second end of the electrical wire, the second connector including a first bumper; and a locking device configured to keep the first connector and the second connector coupled together and to keep the first end and the second end of the wire connected, the locking device including a ring and an arm, wherein the ring is configured to insert over the second connector until the ring is flush with the first bumper of the second connector, and the arm hooks onto the locking hook of the first connector when the ring is flush with the first bumper of the second connector.

In one implementation, the arm of the locking device further includes a slit opening which hooks onto the locking hook of the first connector. In one implementation, the second connector further includes a second bumper that is positioned to substantially reduce the backward movement of the ring of the locking device. In one implementation, the locking hook of the first connector is configured as a ring hook. In one implementation, the arm of the locking device further includes a tip end to hook onto the ring hook. In one implementation, the first connector is configured as a male bullet connector with a protrusion, and the second connector is configured as a female bullet connector with an opening to insert the protrusion. In one implementation, the protrusion includes a wiper ring configured to keep the protrusion firmly within the opening of the female bullet connector. In one implementation, the protrusion further includes bumps and recesses to mate with corresponding bumps and recesses within inner surface of the opening to provide firmer grip for the female bullet connector than without the bumps and recesses. In one implementation, the first bumper of the second connector includes a recess through which the arm of the locking device passes. In one implementation, the electrical connector apparatus further includes a wire housing disposed within the second connector, the wire housing configured to house the electrical connection between the first end and the second end of the wire.

In another implementation, an electrical connector apparatus coupled to first and second ends of an electrical wire used in movable vehicles is disclosed. The method includes: a first connector including a locking hook and coupled to the first end of the electrical wire; a second connector including a first bumper and coupled to the second end of the electrical wire; and a locking device including a ring and an arm, and configured to lock the first connector and the second connector together.

In one implementation, the ring is configured to insert over the second connector until the ring is flush with the first bumper of the second connector, and the arm hooks onto the locking hook of the first connector when the ring is flush with the first bumper of the second connector. In one implementation, the arm of the locking device includes a slit opening which hooks onto the locking hook of the first connector. In one implementation, the second connector includes a second bumper that is positioned to substantially reduce the backward movement of the ring of the locking device. In one implementation, the locking hook of the first connector is configured as a ring hook. In one implementation, the arm of the locking device further includes a tip end to hook onto the ring hook. In one implementation, the first bumper of the second connector includes a recess through which the arm of the locking device passes. In one implementation, the electrical connector apparatus further includes a wire housing disposed within the second connector, the wire housing configured to house the electrical connection between the first end and the second end of the wire.

Other features and advantages of the present disclosure should be apparent from the present description which illustrates, by way of example, aspects of the present disclosure.

BRIEF DESCRIPTION OF THE DRAWINGS

The details of the present disclosure, both as to its structure and operation, may be gleaned in part by study of the appended drawings, in which like reference numerals refer to like parts, and in which.

DETAILED DESCRIPTION

As stated above, there may be several different factors which may cause the electrical connectors to fail and lead to a break in the electrical connections. Therefore, to address the issues involved with the electrical connectors used in moving or movable vehicles or objects, certain implementations of the present disclosure provide for a locking mechanism that holds the electrical connectors together to prevent or at least lower the risk of the break in the electrical connections. Accordingly, after reading this description it will become apparent how to implement the present disclosure in various implementations and applications. Although various implementations of the present disclosure will be described herein, it is understood that these implementations are presented by way of example only, and not limitation. As such, this detailed description of various implementations should not be construed to limit the scope or breadth of the present disclosure.

Figure 1A:
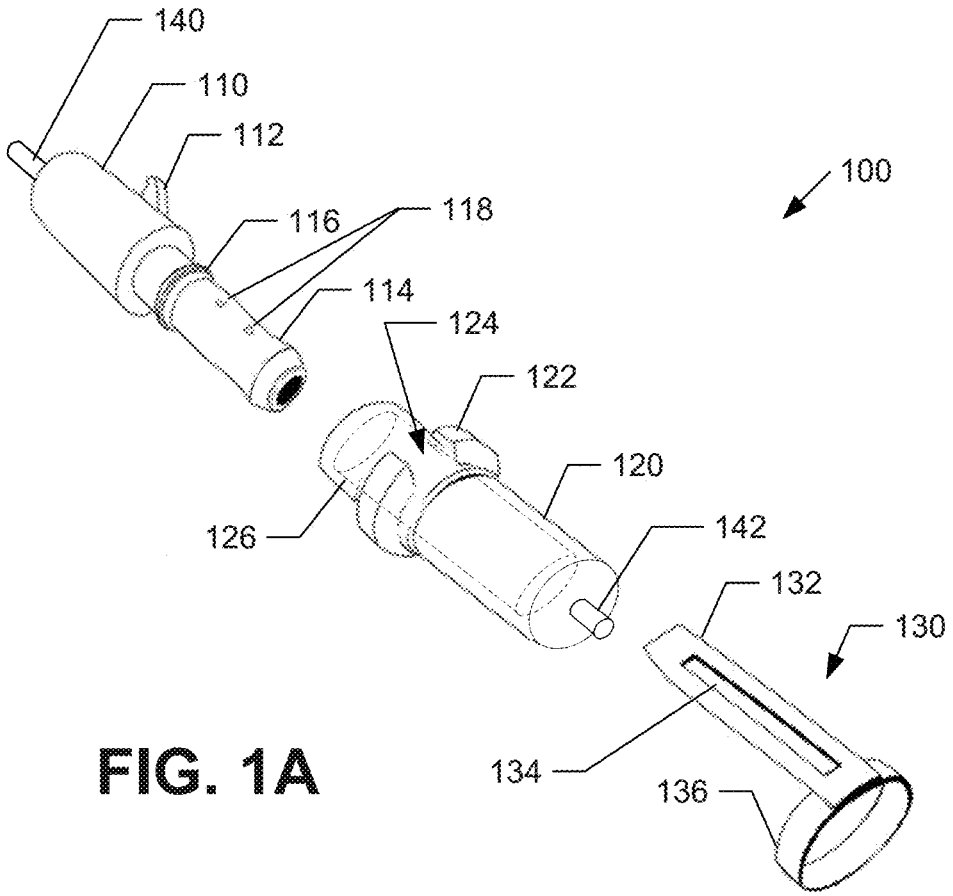
FIG. 1A is an exploded perspective view of an electrical connector apparatus in accordance with one implementation of the present disclosure.

FIG. 1A is an exploded perspective view of an electrical connector apparatus 100 in accordance with one implementation of the present disclosure. In the illustrated implementation of FIG. 1A, the electrical connector apparatus 100 includes a male bullet connector 110, a female bullet connector 120, and a locking device 130. The male bullet connector 110 includes a locking hook 112, a protrusion 114, and a wiper ring 116. The female bullet connector 120 includes an opening 126 to receive the male bullet connector 110 and a bumper 122 with a recess 124. The locking device 130 includes an arm 132 including a ring 136 and a slit opening 134. The exploded view also shows the two ends 140, 142 of the wire connected to the electrical connector apparatus 100.

In operation, the electrical connection between the two ends 140, 142 of the wire is initiated by plugging the protrusion 114 of the male bullet connector 110 into the opening 126 of the female bullet connector 120. In the illustrated implementation of FIG. 1A, the protrusion 114 includes bumps and recesses 118 to mate with corresponding bumps and recesses (not shown) within the inner surface of the opening 126 to provide firmer grip for the female bullet connector 120 than without the bumps and recesses 118.

In the illustrated implementation of FIG. 1A, the protrusion 114 also includes the wiper ring 116, which is configured to keep the male bullet connector 100 firmly within the opening 126 of the female bullet connector 120. In one implementation, the wiper ring 116 is made with at least one rubber ring attached to the outer surface of the protrusion 114. The wiper ring 116 locks into at least one corresponding recess (not shown) made in the inner surface of the opening 126.

In operation, after the protrusion 114 of the male bullet connector 110 is plugged into the opening 126 of the female bullet connector 120, the electrical connection between the two ends 140, 142 of the wire is further maintained by inserting the ring 136 of the locking device 130 over the female bullet connector 120 and by applying the arm 132 over the locking hook 112 of the male bullet connector 110. As the ring 136 of the locking device 130 slides over the outer surface of the female bullet connector 120 and the arm 132 slides through the recess 124, the ring 136 comes in contact with the bumper 122. As the arm 132 slides through the recess 124, the arm 132 moves over the locking hook 112 of the male bullet connector 110. When the forward movement of the ring 136 (and the arm 132) is blocked by the bumper 122, the slit opening 134 of the arm 132 is in position above the locking hook 112 and the slit opening 134 hooks onto the locking hook 112. Therefore, when the locking device 130 is in a locked position as described above, the locking device 130 (in conjunction with other items such as the wiper ring 116 and the bumps/recesses 118) keeps the connectors 110, 120 firmly connected to maintain the electrical connection through the two ends 140, 142 of the wire.

Figure 1B:
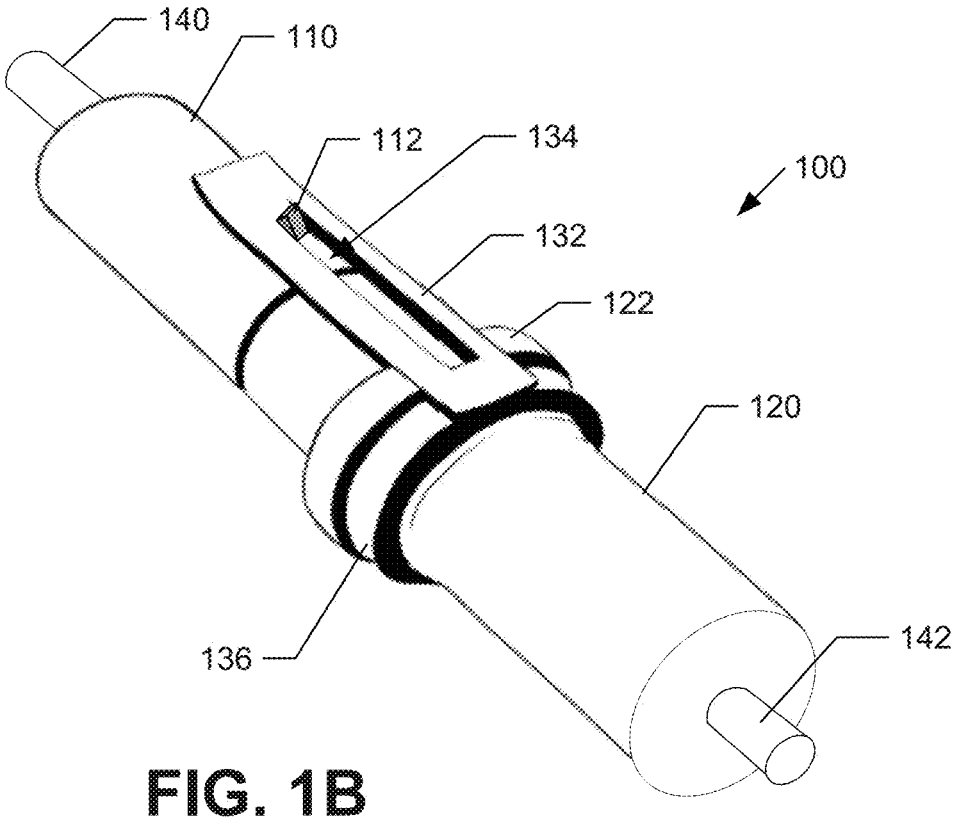
FIG. 1B is a perspective view of the electrical connector apparatus in a locked position in accordance with one implementation of the present disclosure.

FIG. 1B is a perspective view of the electrical connector apparatus 100 in a locked position in accordance with one implementation of the present disclosure. In the locked position of FIG. 1B, the ring 136 is slid over the female bullet connector 120 and positioned flush with the bumper 122. Further, the slit opening 134 of the arm 132 hooks onto the locking hook 112 of the male bullet connector 110. This keeps the connectors 110, 120 firmly connected with enough force to maintain the electrical connection through the two ends 140, 142 of the wire, even under extreme movements and vibrations.

Figure 2:
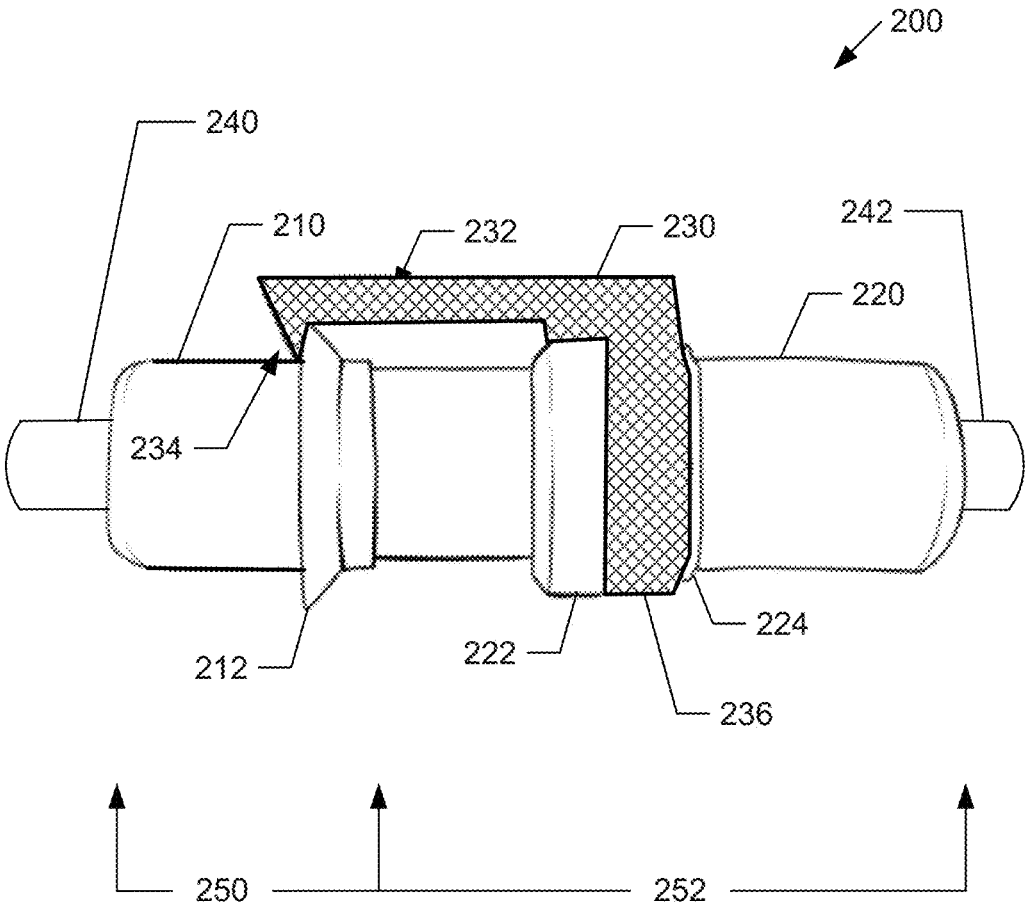
FIG. 2 is a side view of an electrical connector apparatus in accordance with another implementation of the present disclosure.

FIG. 2 is a side view of an electrical connector apparatus 200 in accordance with another implementation of the present disclosure. In the illustrated implementation of FIG. 2, the electrical connector apparatus 200 includes a first connector 210 having a first length 250 and a second connector 220 having a second length 252. The two connectors 210, 220 connect to make an electrical connection between the two ends 240, 242 of the wire. In FIG. 2, the electrical connector apparatus 200 also includes a locking device 230.

In the illustrated implementation of FIG. 2, the first connector 210 includes a ring hook 212, while the second connector 220 includes a front bumper 222. The second connector 220 may also include a back bumper 224. In one implementation, the connectors 210, 220 are bullet connectors similar to those described and shown in FIGS. 1A and 1B. In another implementation, the connectors 210, 220 are male and female socket connectors. In yet another implementation, the connectors 210, 220 are wire connectors which simply connects the two ends 240, 242 of the wire (e.g., copper wire) together.

In the illustrated implementation of FIG. 2, the locking device 230 includes an arm 232 on one end and a ring 236 on the other end. The arm 232 is configured with a tip end 234 to hook onto the ring hook 212 on the first connector 210 when the locking device 230 is in a locked position (as shown in FIG. 2). Thus, when the locking device 230 is in the locked position, the ring 236 is pushed adjacent to the front bumper 222 and the tip end 234 of the arm 232 hooks onto the ring hook 212 to keep the two connectors 210, 220 firmly connected. The back bumper 224 is positioned to prevent or substantially reduce the backward movement of the ring 236 of the locking device 230 and to keep the two connectors 210, 220 firmly in place.

Figure 3A:
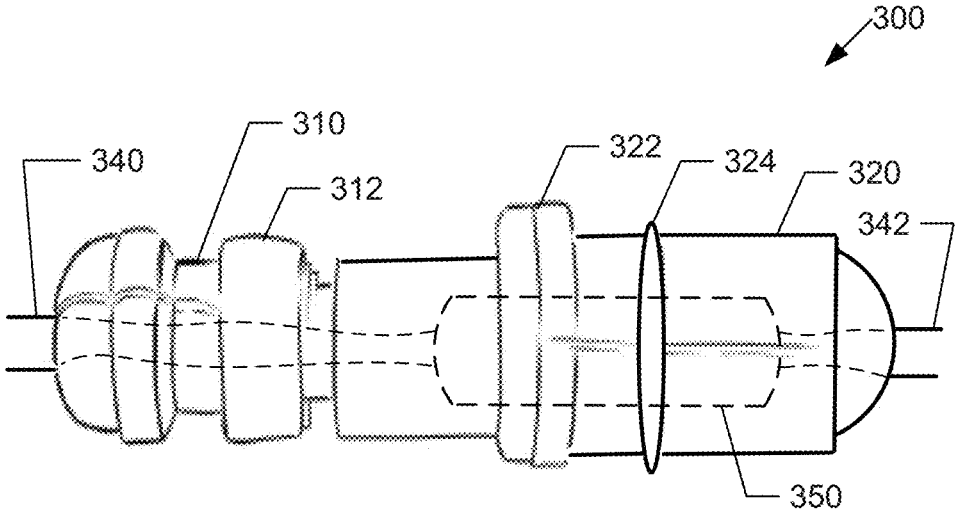
FIG. 3A is a side view of an electrical connector apparatus in accordance with yet another implementation of the present disclosure.

FIG. 3A is a side view of an electrical connector apparatus 300 in accordance with yet another implementation of the present disclosure. In the illustrated implementation of FIG. 3A, the electrical connector apparatus 300 includes a first connector 310 and a second connector 320. The two connectors 310, 320 connect to make an electrical connection between the two ends 340, 342 of the wire. In FIG. 3A, the first connector 310 includes a stopper 312, while the second connector 320 includes a front bumper 322 and a back bumper 324. FIG. 3A also shows a wire housing 350 where the connection between the two ends 340, 342 of the wire is made. The wire housing 350 is shown with dotted lines to indicate that it is inside the second connector 320 and that it is not visible from outside. In some implementations, the wire housing 350 may reside inside the first connector 310 or in the middle between the first connector 310 and the second connector 320.

Figure 3B:
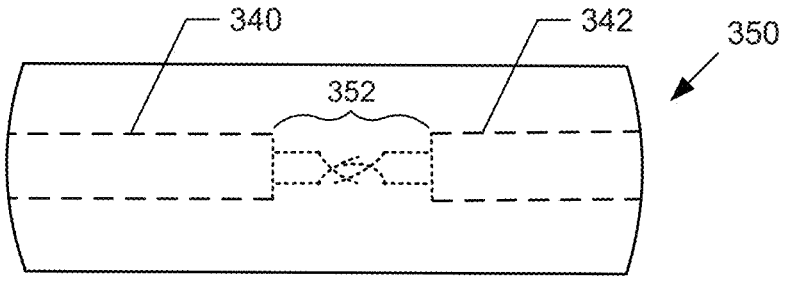
FIG. 3B is a detailed cut-away view of the wire housing in accordance with one implementation of the present disclosure.

FIG. 3B is a detailed cut-away view of the wire housing 350 in accordance with one implementation of the present disclosure. The illustrated implementation of FIG. 3B shows the two ends 340, 342 of the electrical wire and the connection 352 within the wire housing 350. In one implementation, the two ends 340, 342 of the wire are twisted together. In another implementation, the two ends 340, 342 of the wire are soldered together.

Figure 3C:
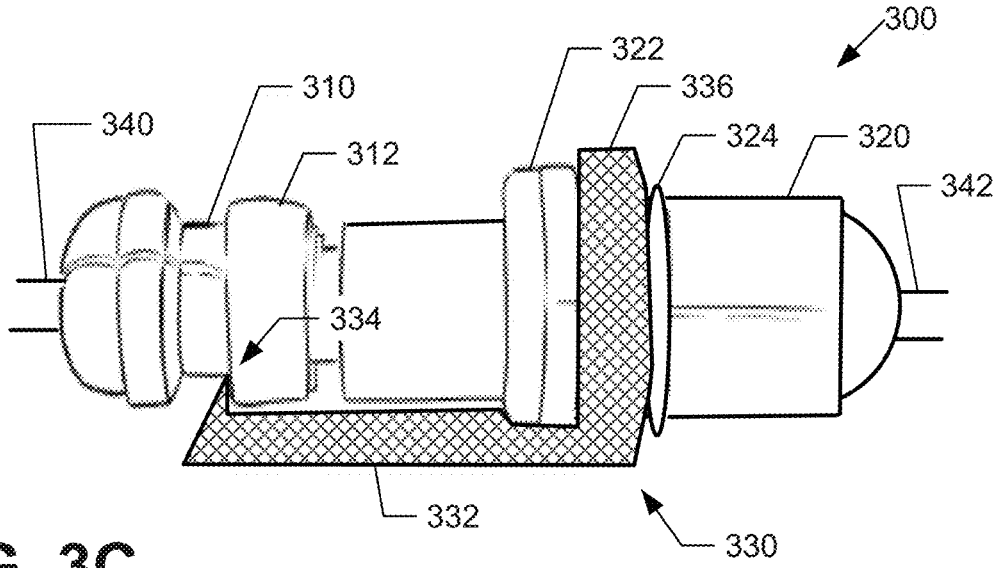
FIG. 3C is a side view of the electrical connector apparatus including the locking device.

FIG. 3C is a side view of the electrical connector apparatus 300 including the locking device 330. In the illustrated implementation of FIG. 3C, the locking device 330 includes an arm 332 on one end and a ring 336 on the other end. The arm 332 is configured with a hook 334 to hook onto the stopper 312 on the first connector 310 when the locking device 330 is in a locked position (as shown in FIG. 3C). Thus, when the locking device 330 is in the locked position, the ring 336 is pushed adjacent to the front bumper 322 and the hook 334 of the arm 332 hooks onto the stopper 312 to keep the two connectors 310, 320 firmly connected. The back bumper 324 provides an additional force behind the ring 336 to keep the two connectors 310, 320 firmly in place.

The above description of the disclosed implementations is provided to enable any person skilled in the art to make or use the invention as described in the specification presented above. Various modifications to these implementations will be readily apparent to those skilled in the art, and the generic principles described herein can be applied to other implementations without departing from the spirit or scope of the disclosure. Accordingly, the techniques are not limited to the specific examples described above. Thus, it is to be understood that the description and drawings presented herein represent a presently possible implementation of the disclosure and are therefore representative of the subject matter that is broadly contemplated by the present disclosure. It is further understood that the scope of the present disclosure fully encompasses other implementations that may become obvious to those skilled in the art and that the scope of the present disclosure is accordingly limited by nothing other than the appended claims.

The invention claimed is:

1. An electrical connector apparatus, comprising:

a first connector coupled to a first end of an electrical wire, the first connector including a locking hook;

a second connector coupled to a second end of the electrical wire, the second connector including a first bumper; and a locking device configured to keep the first connector and the second connector coupled together and to keep the first end and the second end of the wire connected, the locking device including a ring and an arm, wherein the ring is configured to insert over the second connector until the ring is flush with the first bumper of the second connector, and the arm hooks onto the locking hook of the first connector when the ring is flush with the first bumper of the second connector, wherein the first connector is configured as a male bullet connector with a protrusion, and the second connector is configured as a female bullet connector with an opening to insert the protrusion, wherein the protrusion further includes bumps and recesses to mate with corresponding bumps and recesses within inner surface of the opening to provide firmer grip for the female bullet connector than without the bumps and recesses.

2. The electrical connector apparatus of claim 1, wherein the arm of the locking device further includes a slit opening which hooks onto the locking hook of the first connector.

3. The electrical connector apparatus of claim 1, wherein the second connector further includes a second bumper that is positioned to substantially reduce the backward movement of the ring of the locking device.

4. The electrical connector apparatus of claim 1, wherein the locking hook of the first connector is configured as a ring hook.

5. The electrical connector apparatus of claim 4, wherein the arm of the locking device further includes a tip end to hook onto the ring hook.

6. The electrical connector apparatus of claim 1, wherein the protrusion further includes a wiper ring configured to keep the protrusion firmly within the opening of the female bullet connector.

7. The electrical connector apparatus of claim 1, wherein the first bumper of the second connector includes a recess through which the arm of the locking device passes.

8. The electrical connector apparatus of claim 1, further comprising a wire housing disposed within the second connector, the wire housing configured to house the electrical connection between the first end and the second end of the wire.

9. An electrical connector apparatus coupled to first and second ends of an electrical wire used in movable vehicles, the electrical connector apparatus comprising:

a first connector including a locking hook and coupled to the first end of the electrical wire;

a second connector including a first bumper and coupled to the second end of the electrical wire; and a locking device including a ring and an arm, and configured to lock the first connector and the second connector together, wherein the ring is configured to insert over the second connector until the ring is flush with the first bumper of the second connector, and the arm hooks onto the locking hook of the first connector when the ring is flush with the first bumper of the second connector, wherein the first connector is configured as a male bullet connector with a protrusion, and the second connector is configured as a female bullet connector with an opening to insert the protrusion, wherein the protrusion further includes bumps and recesses to mate with corresponding bumps and recesses within inner surface of the opening to provide firmer grip for the female bullet connector than without the bumps and recesses.

10. The electrical connector apparatus of claim 9, wherein the arm of the locking device includes a slit opening which hooks onto the locking hook of the first connector.

11. The electrical connector apparatus of claim 9, wherein the second connector includes a second bumper that is positioned to substantially reduce the backward movement of the ring of the locking device.

12. The electrical connector apparatus of claim 9, wherein the locking hook of the first connector is configured as a ring hook.

13. The electrical connector apparatus of claim 12, wherein the arm of the locking device further includes a tip end to hook onto the ring hook.

14. The electrical connector apparatus of claim 9, wherein the first bumper of the second connector includes a recess through which the arm of the locking device passes.

15. The electrical connector apparatus of claim 9, further comprising a wire housing disposed within the second connector, the wire housing configured to house the electrical connection between the first end and the second end of the wire.

* * * * *